US008096271B2

(12) United States Patent
Hu et al.

(10) Patent No.: US 8,096,271 B2
(45) Date of Patent: Jan. 17, 2012

(54) SYSTEM AND METHOD FOR DETERMINING A CAMSHAFT POSITION IN A VARIABLE VALVE TIMING ENGINE

(75) Inventors: Yiran Hu, Powell, MI (US); Kenneth P. Dudek, Rochester Hills, MI (US); Shawn W. Midlam-Mohler, Columbus, OH (US); Yann G. Guezennec, Upper Arlington, OH (US); Stephen Yurkovich, Columbus, OH (US); Layne K. Wiggins, Plymouth, MI (US)

(73) Assignee: GM Global Technology Operations LLC

( * ) Notice: Subject to any disclaimer, the term of this patent is extended or adjusted under 35 U.S.C. 154(b) by 418 days.

(21) Appl. No.: 12/475,749

(22) Filed: Jun. 1, 2009

(65) Prior Publication Data

US 2010/0300387 A1 Dec. 2, 2010

(51) Int. Cl.
*F01L 1/34* (2006.01)

(52) U.S. Cl. ..... 123/90.15; 123/90.17; 123/347

(58) Field of Classification Search ..... 123/90.15, 123/90.16, 90.17, 90.18, 345, 346, 347, 348
See application file for complete search history.

(56) References Cited

U.S. PATENT DOCUMENTS 7,669,563 B2 * 3/2010 Fujii ..... 123/90.15

* cited by examiner

*Primary Examiner* — Ching Chang

(57) ABSTRACT

A control module and system includes a camshaft position module that determines a camshaft position change of a crankshaft. The control module also includes a cam phaser velocity module determines a cam phaser velocity based on the camshaft position change. A cam phaser velocity module determines a compensation factor based on the cam phaser velocity. A cam position compensation module generates a corrected cam position signal based on the compensation factor.

20 Claims, 7 Drawing Sheets

SYSTEM AND METHOD FOR DETERMINING A CAMSHAFT POSITION IN A VARIABLE VALVE TIMING ENGINE

FIELD OF THE INVENTION

The present disclosure relates to variable valve actuation systems, and more particularly to a system and method for determining the position of the camshaft.

BACKGROUND OF THE INVENTION

The statements in this section merely provide background information related to the present disclosure and may not constitute prior art.

Vehicles include an internal combustion engine that generates drive torque. More specifically, an intake valve is selectively opened to draw air into the cylinders of the engine. The air is mixed with fuel to form a combustion mixture. The combustion mixture is compressed within the cylinders and is combusted to drive pistons within the cylinders. An exhaust valve selectively opens to allow the exhaust gas to exit from the cylinders after combustion.

A rotating camshaft regulates the opening and closing of the intake and exhaust valves. The camshaft includes a plurality of cam lobes that rotate with the camshaft. The profile of the cam lobe determines the valve lift schedule. More specifically, the valve lift schedule includes the amount of time the valve is open (duration) and the magnitude or degree to which the valve opens (lift).

Variable valve actuation (VVA) technology improves fuel economy, engine efficiency, and/or performance by modifying a valve lift event, timing, and duration as a function of engine operating conditions. Two-step VVA systems include variable valve assemblies such as hydraulically controlled switchable roller finger followers (SRFFs). SRFFs enable two discrete valve states (e.g. a low lift state or a high lift state) on the intake and/or exhaust valves.

A control module transitions an SRFF mechanism from a low lift state to a high lift state and vice versa based on demanded engine speed and load. For example, an internal combustion engine operating at an elevated engine speed such as 4,000 revolutions per minute (RPMs) typically requires the SRFF mechanism to operate in a high lift state to avoid potential hardware damage to the internal combustion engine.

For engines equipped with variable valve timing, accurate cam position measurement ensures proper operation of the internal combustion engine. In current GM engines, the measurement used is a direct measurement from a four-tooth encoder on the camshaft. Each tooth has a unique shape, which when detected signifies a specific cam position measurement. The latest measurement is stored in the memory for use by the various controllers. In particular, the intake charge estimation algorithm uses this measurement at every low-res intake event to calculate the amount of charge for each cylinder.

Because the encoder resolution (number of teeth) is low, there is usually a sizable delay between the measurement update and the low-resolution event that requires the measurement. Because the cam phaser continues to move during this delay, the measurement may become inaccurate. In one test, as much as a five-degree difference between the actual position and the measured position was determined.

SUMMARY

A camshaft position estimator is used to reduce the measurement error caused by the delay. To do this, the measurement delay is modeled. The velocity of the camshaft phaser is estimated. Based on camshaft phaser, the amount of movement that occurred during the delay can be calculated. The amount of movement may be used to form a compensation that can be used to correct the measurement.

In one aspect of the disclosure, a method includes determining a camshaft position change, determining a cam phaser velocity based on the camshaft position change, determining a compensation factor based on the cam phaser velocity and generating a corrected cam position signal based on the compensation factor.

In another aspect of the disclosure, a control module includes a camshaft position module that determines a camshaft position change of a camshaft. The control module also includes a cam phaser velocity module determines a cam phaser velocity based on the camshaft position change. A cam phaser velocity module determines a compensation factor based on the cam phaser velocity. A cam position compensation module generates a corrected cam position signal based on the compensation factor.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
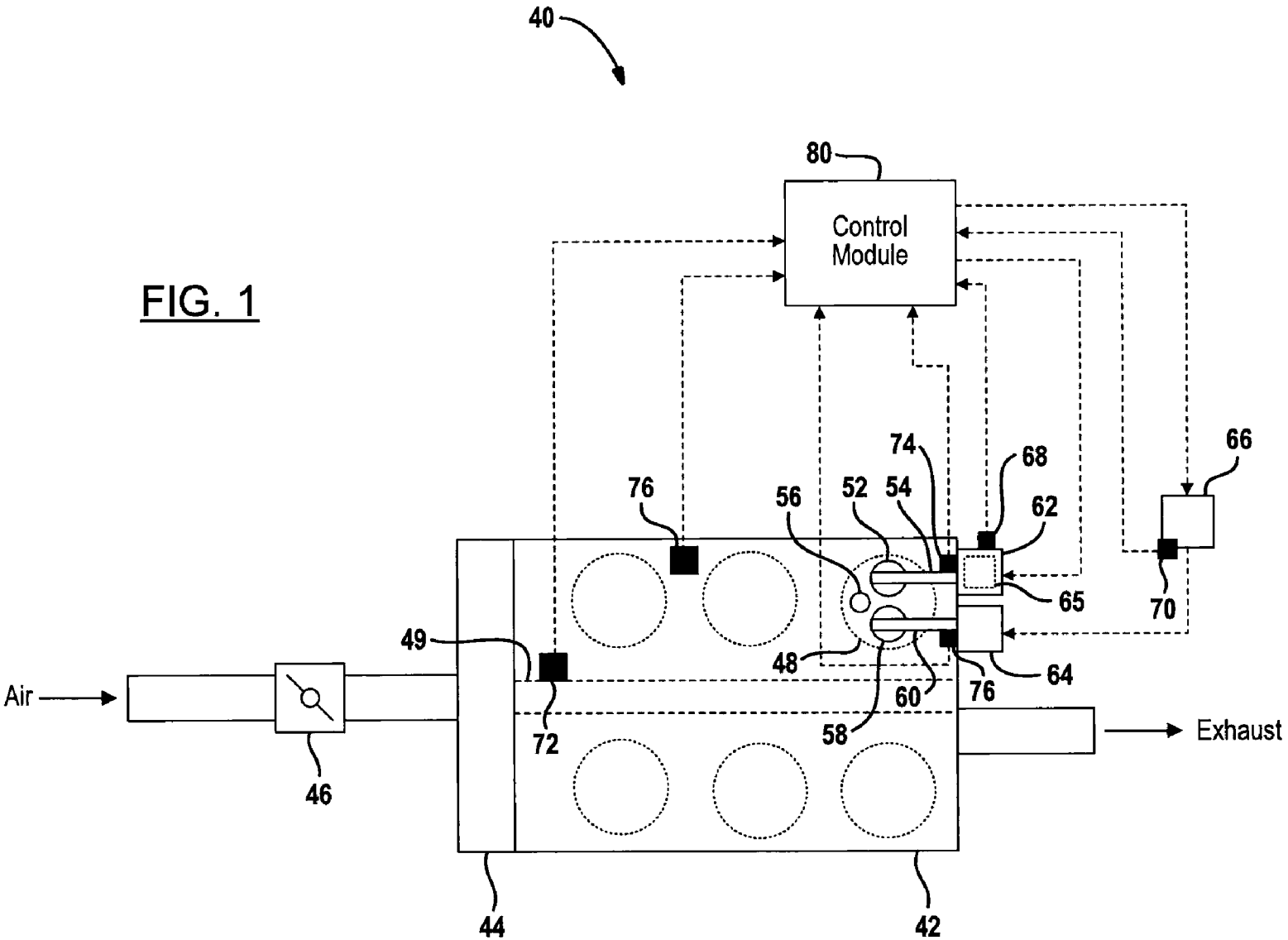
FIG. 1 is a functional block diagram of an exemplary vehicle according to the present disclosure.
Figure 2:
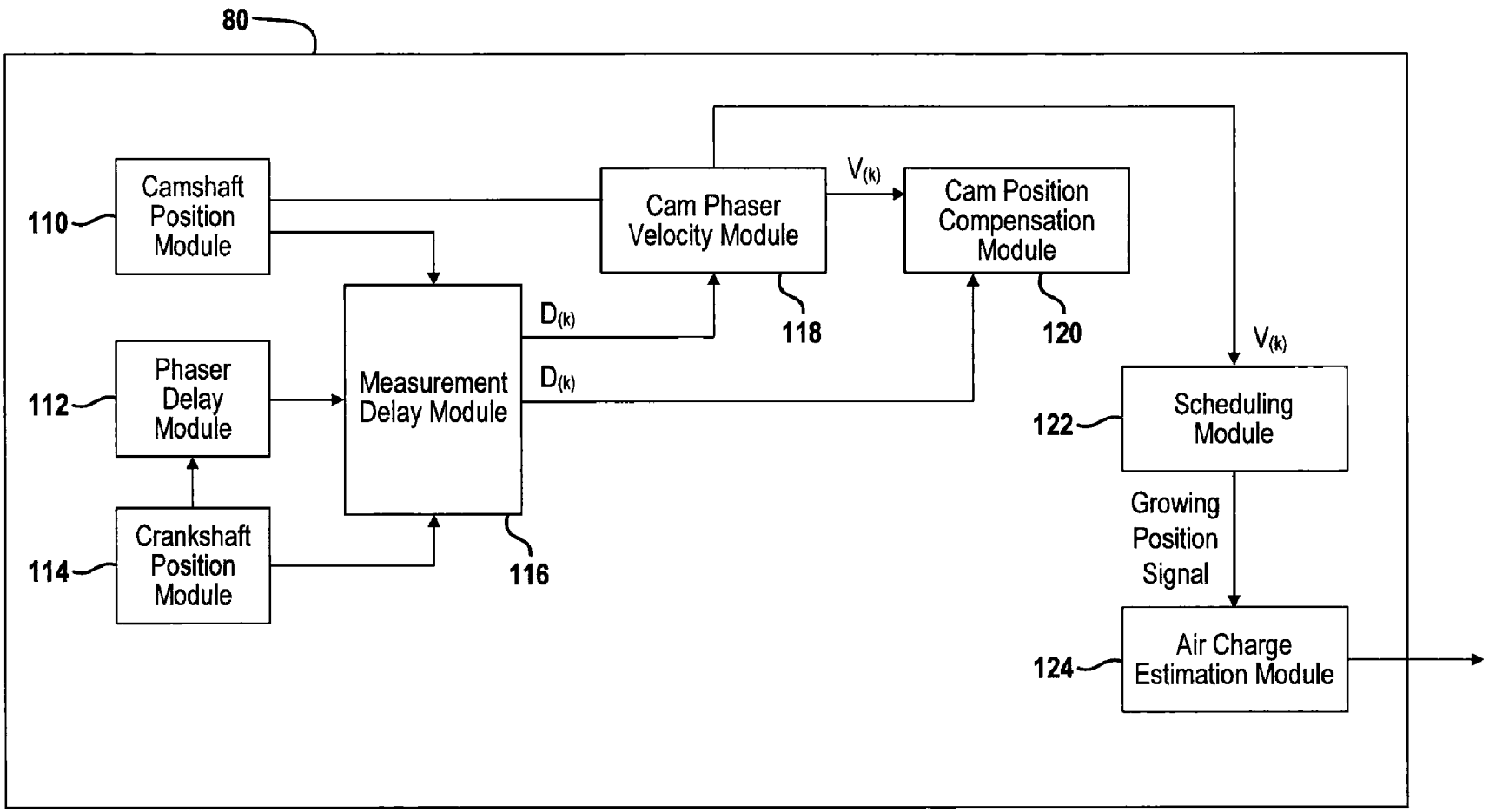
FIG. 2 is a functional block diagram illustrating an exemplary module that executes the method of the present disclosure.

The following description of the preferred embodiment is merely exemplary in nature and is in no way intended to limit the invention, its application, or uses. For purposes of clarity, the same reference numbers will be used in the drawings to identify similar elements. As used herein, activated refers to operation using all of the engine cylinders. Deactivated refers to operation using less than all of the cylinders of the engine (one or more cylinders not active). As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Referring now to FIG. 1, an engine system 40 includes an engine 42 that combusts an air and fuel mixture to produce drive torque. Air is drawn into an intake manifold 44 through a throttle 46. The throttle 46 regulates mass air flow into the intake manifold 44. Air within the intake manifold 44 is distributed into cylinders 48. Although six cylinders 48 are illustrated, it is appreciated that the diagnostic system of the present invention can be implemented in engines having a plurality of cylinders including, but not limited to, 2, 3, 4, 5, 8, 10, and 12 cylinders.

A fuel injector (not shown) injects fuel that is combined with the air as it is drawn into the cylinder 48 through an intake port. The fuel injector may be an injector associated with an electronic or mechanical fuel injection system, a jet or port of a carburetor or another system for mixing fuel with intake air. The fuel injector is controlled to provide a desired air-to-fuel (A/F) ratio within each cylinder 48.

An intake valve 52 selectively opens and closes to enable the air/fuel mixture to enter the cylinder 48. The intake valve position is regulated by an intake camshaft 54. A piston (not shown) compresses the air/fuel mixture within the cylinder 48. A spark plug 56 initiates combustion of the air/fuel mixture, driving the piston in the cylinder 48. The piston drives a crankshaft 49 to produce drive torque. Combustion exhaust within the cylinder 48 is forced out an exhaust port when an exhaust valve 58 is in an open position. The exhaust valve position is regulated by an exhaust camshaft 60. The exhaust is treated in an exhaust system. Although single intake and exhaust valves 52 and 58 are illustrated, it can be appreciated that the engine 42 can include multiple intake and exhaust valves 52 and 58 per cylinder 48.

The engine system 40 may include an intake cam phaser 62 and an exhaust cam phaser 64 that respectively regulate the rotational timing of the intake and exhaust camshafts 54 and 60. More specifically, the timing or phase angle of the respective intake and exhaust camshafts 54 and 60 can be retarded or advanced with respect to each other or with respect to a location of the piston within the cylinder 48 or with respect to the position of the crankshaft 49.

In this manner, the position of the intake and exhaust valves 52 and 58 can be regulated with respect to each other or with respect to a location of the piston within the cylinder 48. By regulating the position of the intake valve 52 and the exhaust valve 58, the quantity of air/fuel mixture ingested into the cylinder 48, and therefore the engine torque, is regulated.

The cam phaser 62 can include a phaser actuator 65 that is either electrically or hydraulically actuated. Hydraulically actuated phaser actuators 65, for example, include an electrically-controlled fluid control valve (OCV) 66 that controls a fluid supply flowing into or out of the phaser actuator 65.

Additionally, low lift cam lobes (not shown) and high lift cam lobes (not shown) are mounted to each of the intake and exhaust camshafts 54, 60. The low lift cam lobes and high lift cam lobes rotate with the intake and exhaust camshafts 54 and 60 and are in operative contact with a hydraulic lift mechanism such as a switching roller finger follower (SRFF). Typically, distinct SRFF mechanisms operate on each of the intake and exhaust valves 52 and 58 of each cylinder 48. Each cylinder 48 may, for example, includes two SRFF mechanisms.

Each SRFF mechanism provides two levels of valve lift for one of the intake and exhaust valves 52 and 58. The two levels of valve lift include a low lift and high lift and are based on the low lift cam lobes and high lift cam lobes, respectively. During "normal" operation (i.e. low lift operation or a low lift state), a low lift cam lobe causes the SRFF mechanism to pivot to a second position in accordance with the prescribed geometry of the low lift cam lobe and thereby open one of the intake and exhaust valves 52 and 58 a first predetermined amount. During high lift operation (i.e. a high lift state), a high lift cam lobe causes the SRFF mechanism to pivot to a third position in accordance with the prescribed geometry of the high lift cam lobe and thereby opening one of the intake and exhaust valves 52 and 58 to open a second predetermined amount greater than the first predetermined amount.

A position sensor 68 senses a position of the cam phaser 62 and generates a cam phaser position signal indicative of the position of the cam phaser 62. A pressure sensor 70 generates a pressure signal indicating a pressure of the fluid supply supplied to the phaser actuator 65 of the cam phaser 62. It is anticipated that one or more pressure sensors 70 can be implemented. An engine speed sensor 72 is responsive to a rotational speed of the crankshaft 49 of the engine 42 and generates an engine speed signal in revolutions per minute (RPM).

An intake camshaft position sensor 74 may generate an intake camshaft position sensor signal corresponding to the position of the intake camshaft. The intake camshaft position sensor 74 may include a four-toothed wheel that completes a revolution every engine cycle. As mentioned above, there may be a delay between the camshaft position measurements and their use in the engine control algorithms such as an in-cylinder air mass prediction. An exhaust camshaft position sensor 76 may be positioned on the exhaust camshaft 60 to generate a similar signal. Both the intake and exhaust camshafts may benefit by the present disclosure.

A control module 80 includes a processor and memory such as random access memory (RAM), read-only memory (ROM), and/or other suitable electronic storage. The control module 80 may receive signals from the various sensors and generate a corrected camshaft position signal for use by various engine control functions, such as an air-charged termination. The control module 80 may receive input from other sensors 82 of the exemplary vehicle 40 including, but not limited to, oxygen sensors, engine coolant temperature sensors, and/or mass airflow sensors.

Figure 3:
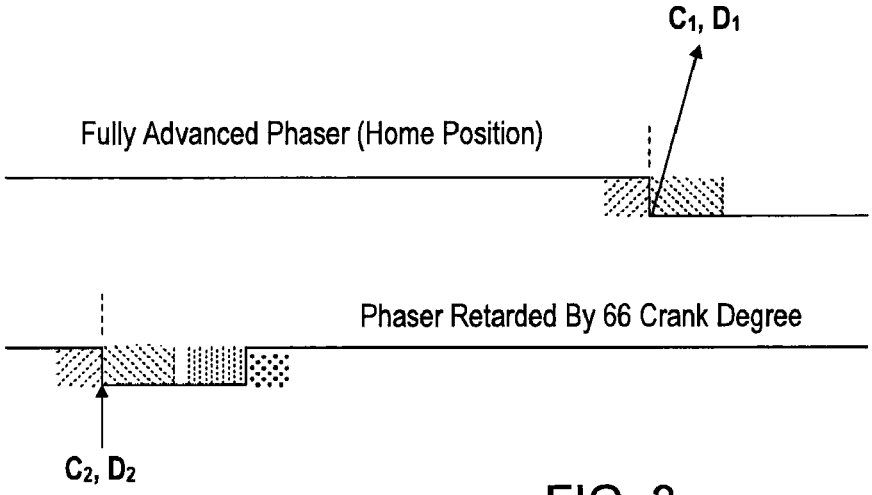
FIG. 3 is a timing diagram of a cam phaser in a fully advanced position and in a fully retarded position.

Referring now to FIG. 3, the control module 80 is shown in more detail. The control module 80 includes a camshaft position module 110 that generates camshaft position signals corresponding to the position of the camshaft. As mentioned above, the camshaft position module 110 may be in communication with the camshaft position sensor. The camshaft position module may be in communication with the intake camshaft position sensor 74, the exhaust camshaft position sensor 76, or both. A phaser delay module 112 generates a phaser delay signal in terms of crankshaft angle degrees. The control module 80 includes a crankshaft position module 114 that generates a crankshaft position signal. The crankshaft position module 110, the phaser delay module 112 and the crankshaft position module 114 are in communication with a measurement delay module 116. The measurement delay module 116 determines a measurement delay between the low-resolution intake events and the latest position update from the encoder measurement. The measurement delay is an affine function of the camshaft position. The unit of the measurement delay is in terms of crank degrees. Let k represent the $k^{th}$ low resolution (low-res) intake event. Then the delay at time k is given by $$D(k)=\alpha*\mathrm{CAM}(k)+\beta \quad (1)$$

The constants $\alpha$ and $\beta$ may be calculated directly from the timing diagram. FIG. 3 shows an illustration. To calculate $\alpha$ and $\beta$, the diagram the measurement delay is determined when the cam phaser is fully advanced. The advanced delay is delay $D_1$, and the cam position at the fully advanced cam phaser position is $C_1$. The measurement delay when the cam phaser is fully retarded is then determined. The retarded cam phaser position delay is $D_2$. The cam position at the fully retarded phaser position is $C_2$. This gives two pairs of values that satisfy Equation (1) (namely ($C_1$, $D_1$), and ($C_2$, $D_2$)). Then α and β may be calculated in the measurement delay module 116 as follows:

$$\alpha = \frac{D_2 - D_1}{C_2 - C_1} \tag{2}$$

$$\beta = D_1 - \frac{D_2 - D_1}{C_2 - C_1} C_1$$

The measurement delay module 116 may be in communication with a cam phaser velocity module 118. The camshaft position signals from the camshaft position module 110 may also be provided to the cam phaser velocity module 118. The velocity of the cam phaser can be calculated via a backwards difference. Let R(k) be the change in cam position measurement between event k and k−1. i.e.

$$R(k)=\mathrm{CAM}(k)-\mathrm{CAM}(k-1) \tag{3}$$

where the unit of R(k) is in cam degrees. This change in cam position occurred over $$180-D(k)+D(k+1) \tag{4}$$

crank degrees. The velocity of the cam phaser is represented by V(k), with the units cam degree per crank degrees. Then V(k) is given $$V(k)=R(k)/(180-D(k)+D(k+1)) \tag{5}$$

The cam phaser velocity signal V(k) is communicated to a cam compensation position module 120. The cam compensation position module 120 also receives a measurement delay signal D(k). The cam compensation position module 120 generates an estimated cam position at *K given by $$\mathrm{CAM}(k)+D(k)*V(k) \tag{6}$$

where CAM(k) is the cam position measurement, V(k) is the cam velocity and D(k) is a the delay. Both D(k) and V(k) may be referred to collectively or separately as compensation factors.

Figure 4:
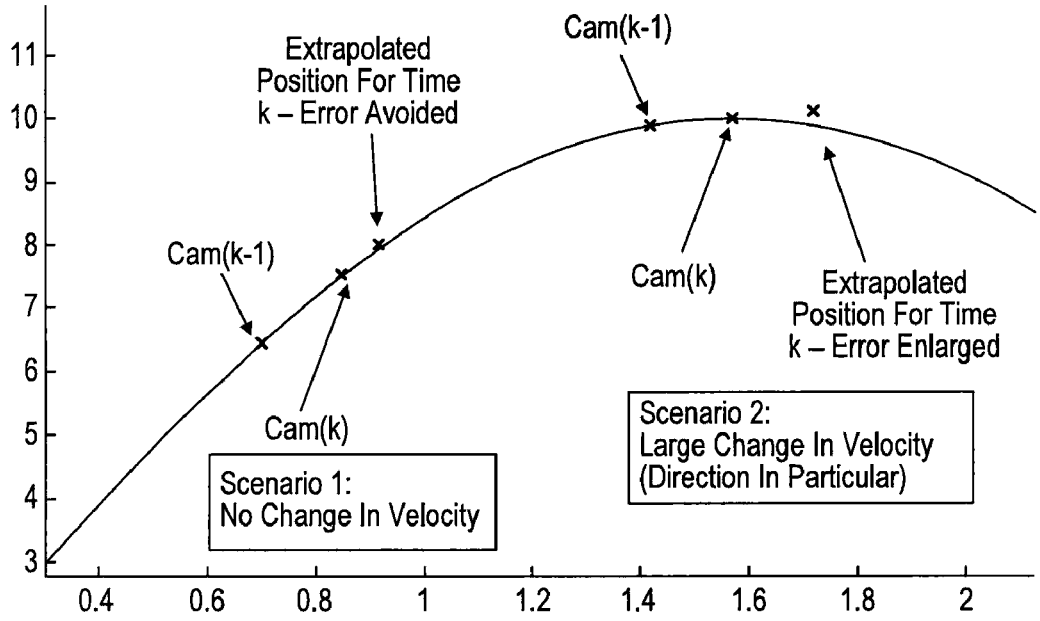
FIG. 4 is a plot of a cam position versus time for two different scenarios of measurement.
Figure 5:
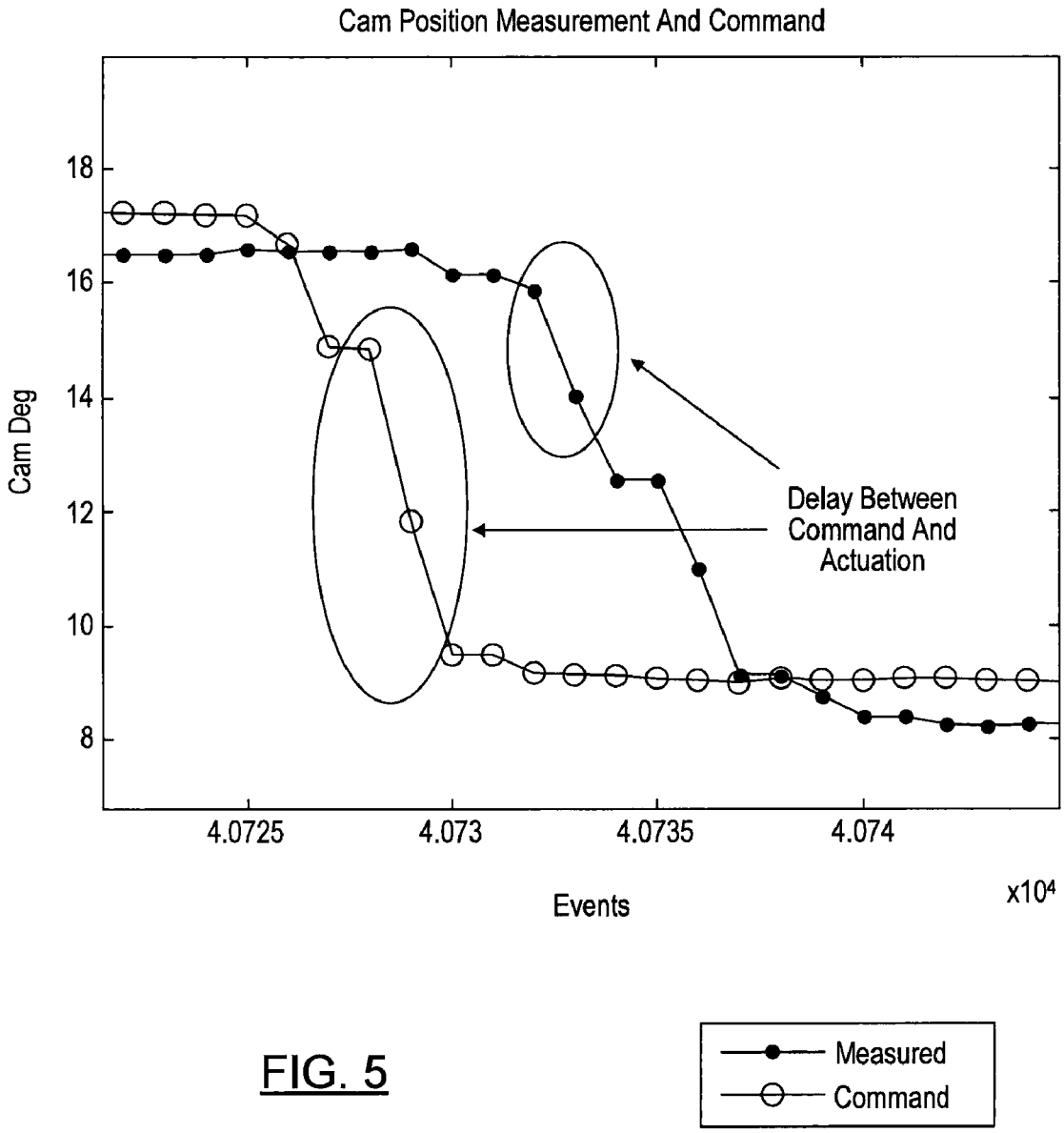
FIG. 5 is a plot of a cam degree angle versus events for a measured and commanded cam position.

The control module 80 includes a scheduling module 122. FIG. 4 illustrates two different scenarios corresponding to the camshaft measurements. The first scenario illustrates no change in velocity since the cam position CAM(k) and cam position CAM(k−1) lie on the line 130. In scenario two, a large change in velocity and indirection is developed between cam position CAM(k−1)' and cam position CAM(k)'. As FIG. 4 illustrates, if the velocity of the phaser changes significantly during the delay, then the position compensation will no longer be valid. The cam position command can be used to forecast the velocity change, because there is delay between a command change and the actuator movement as shown in FIG. 5. The compensation factor is then communicated to other engine control modules such as an air-charge estimation module 124. Based upon the corrected position signal, the air-charge estimation module can provide a more accurate air-charge estimation. When the scheduling module 122 determines that no compensation is required, the scheduling module merely communicates the non-corrected position signal to the air-charge estimation module 124.

The delay between command and actuation can be evaluated experimentally. Let $d_p$ be the delay in phaser actuator between command and actuation. This delay is a function of the RPM because the phaser is actuated with a time based control, not events. The scheduling logic in the air charge estimation module 124 to be used after the delay function is found is as follows: on event k, let $d_p(k)$ be the actuator delay computed for this event; if the trajectory of commanded position on events $k-d_{np}(k)-1$, $k-d_{np}(k)$, and $k-d_{np}(k)+1$ show a change of direction, with magnitude larger than 3 cam degrees, then the compensation factor is not used; in all other scenarios, the predictor should be used to improve the measurement.

Figure 6:
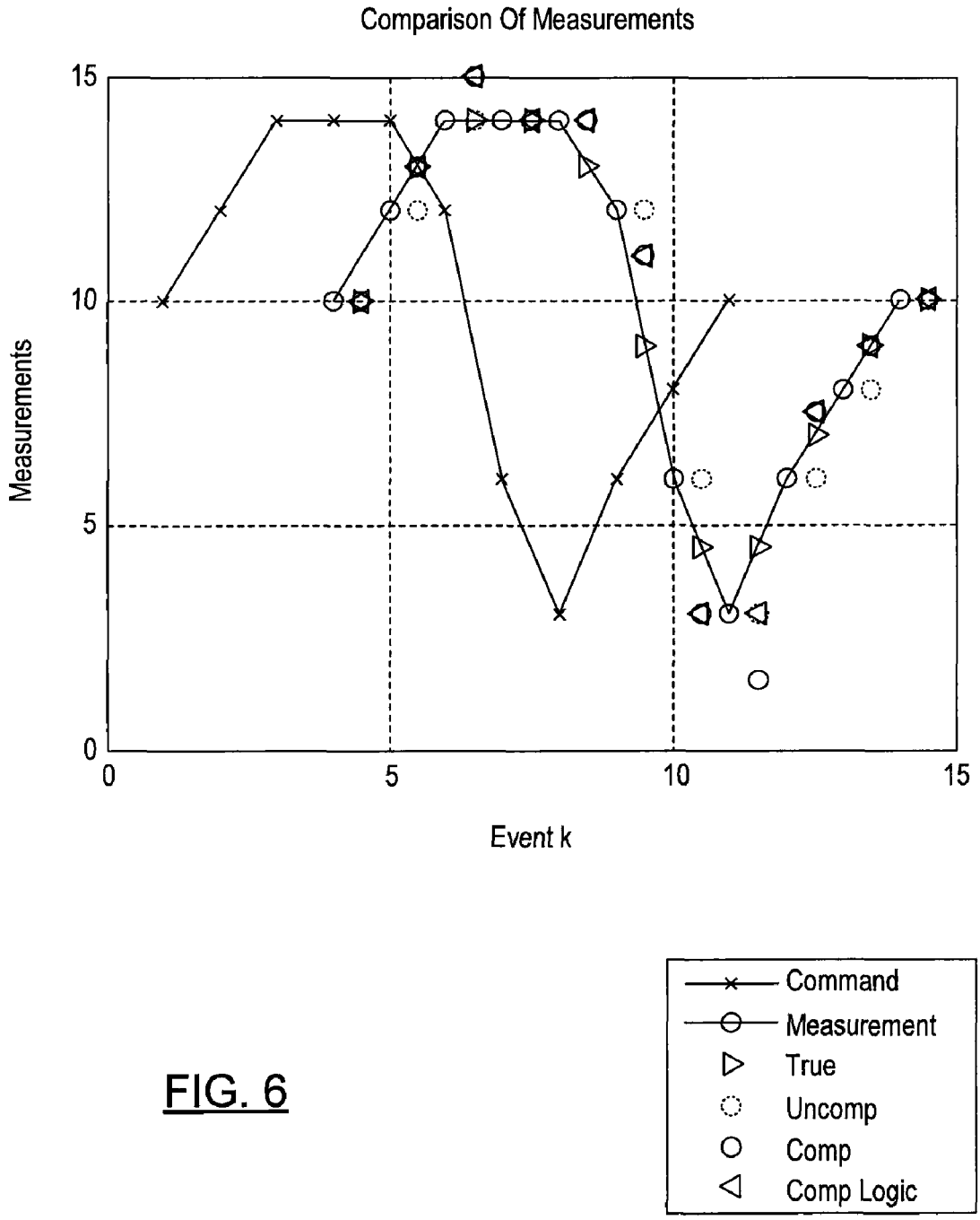
FIG. 6 is a plot of compensated measurements and uncompensated measurements.

Referring now to FIG. 6, a plot of measurements versus time for commands and measurements. As can be seen, the commanded measurements are performed after the true measurements.

Figure 7:
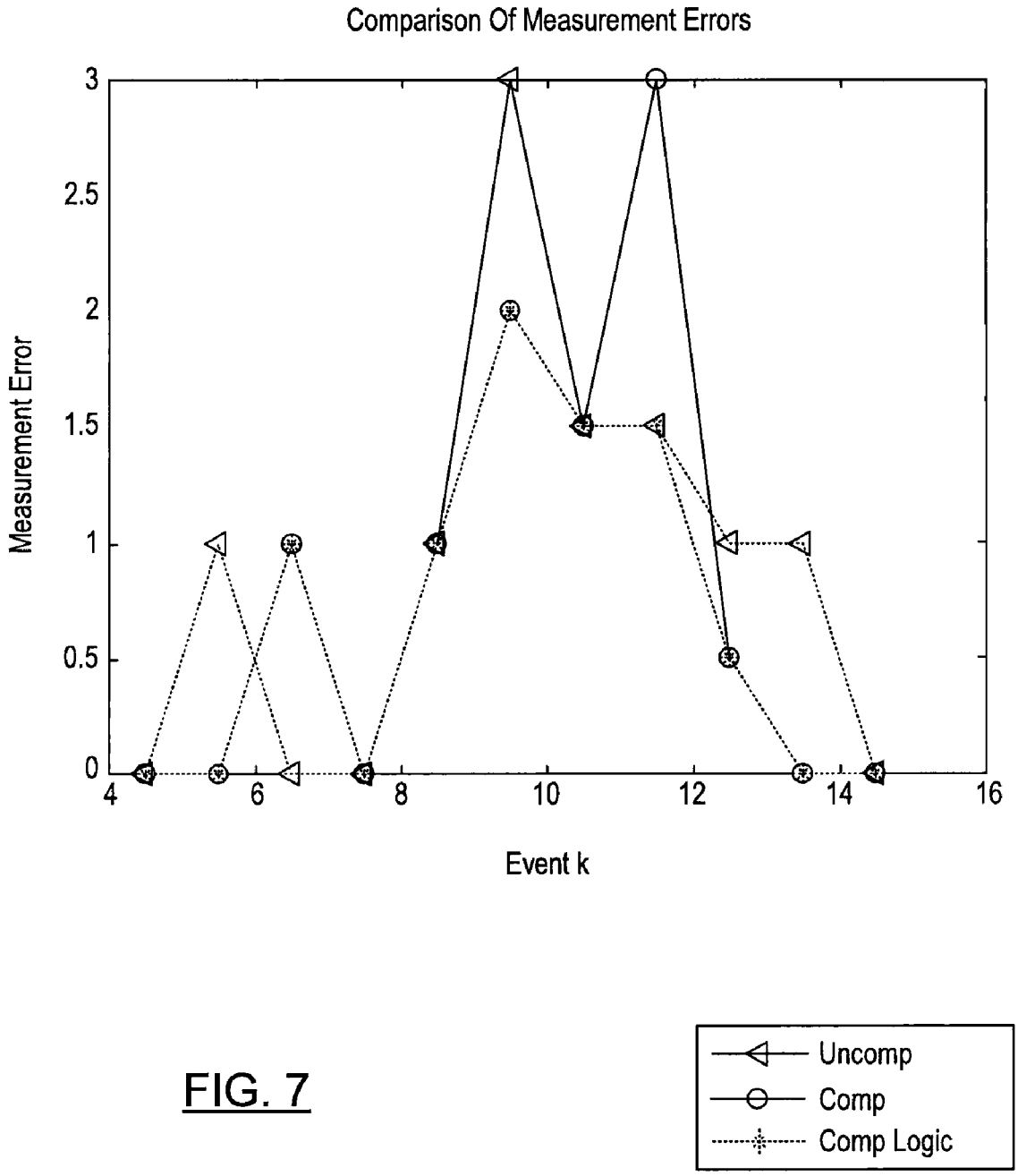
FIG. 7 is a plot of error from compensated measurements and uncompensated measurements.

Referring now to FIG. 7, a comparison of the error from compensated measurements and uncompensated measurements is provided.

Figure 8:
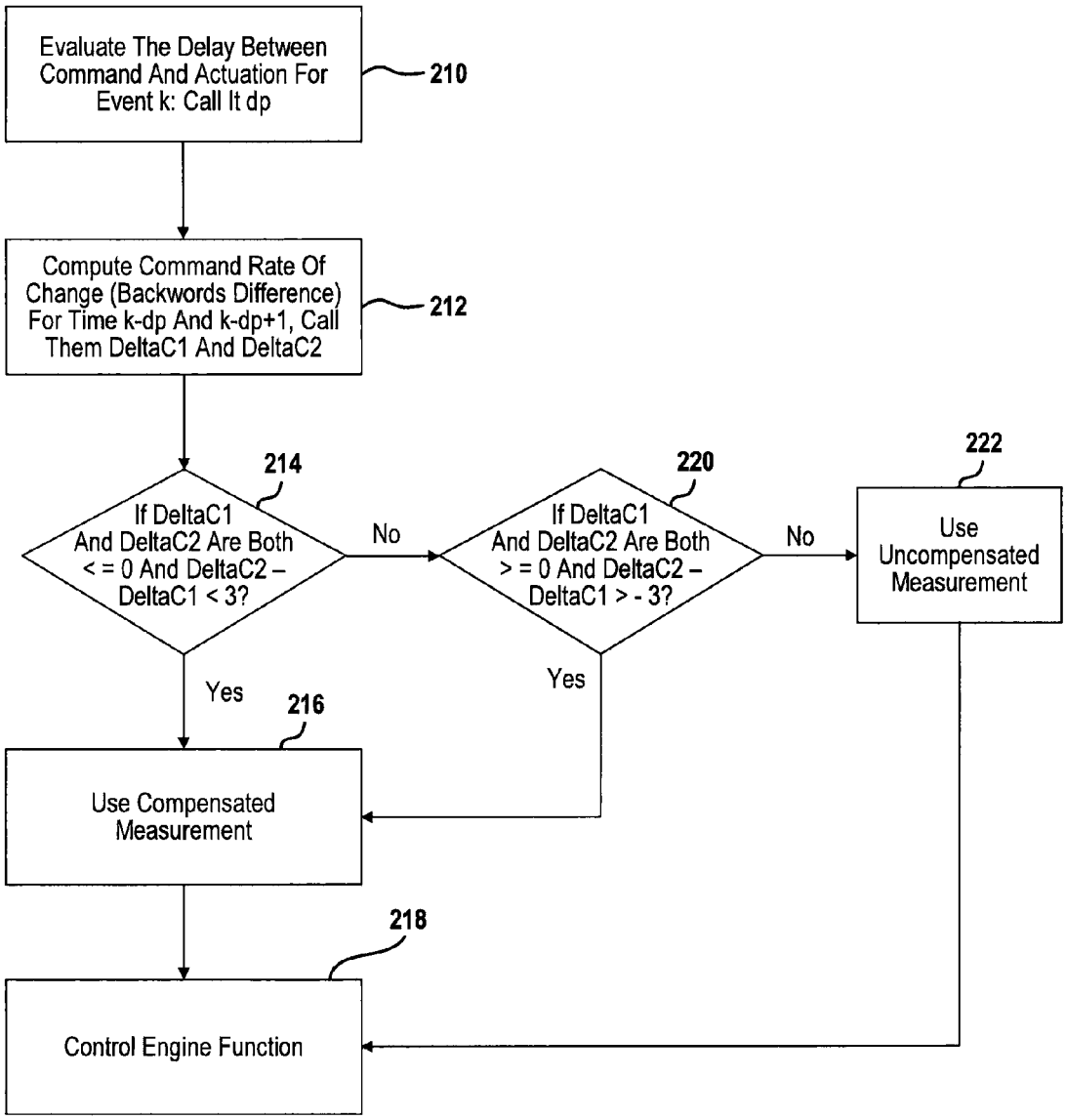
FIG. 8 is a flowchart illustrating a method of operating the diagnostic system of the present disclosure.

Referring now to FIG. 8, a method for operating the diagnostic system is set forth. In step 210, the delay between the command and the actuation for an event is provided. In step 212, the command rate of change, which is a backwards difference for a time k−dp and k−dp+1 are determined. The commanded rates may be set forth as DeltaC1 and DeltaC2. In step 214, when DeltaC1 and DeltaC2 are both less than or equal to zero and DeltaC2 minus DeltaC1 is less than a threshold, a compensated measurement is used in step 216. In step 218, the compensated measurement is used to control an engine function.

In step 214, if DeltaC1 and DeltaC2 are not both less than or equal to zero or DeltaC2 minus DeltaC1 is not less than the threshold, such as three, step 220 determines whether DeltaC1 and DeltaC2 are both greater than or equal to zero and if the difference between DeltaC2 and DeltaC3 is greater than a negative threshold. If the above comparison is true, step 216 applies a compensated measurement. If the above is not true, step 222 uses an uncompensated measurement to control the engine function. For the above illustration, it is presumed that the measurement is a three samples delayed version of the command for simplicity. Also assumed is that the delay between the position data retrieval and measurement is exactly one-half of the sampling period. The true measurement is assumed to be the linear interpolation between the two measurements in between which the data retrieval occurs. Several variables may be evaluated. First, the uncompensated measurement which is basically the most recent measurement held in the memory. Next is the compensation measurement where the compensation is always applied. Last of the compensated measurement with logic where the compensation is applied based on the logic outlined as previously. This logic is set forth in step 220. As FIG. 6 illustrates, the compensated measurement clearly has drawbacks where a large change in the phaser direction causes an unwarranted overcompensation. The compensated measurement with logic improves that to remove the overcompensation could result in a better measurement than the uncompensated measurement in all but one instance (where a small direction change did not trigger the logic). However, in this instance the threshold may be changed to something different than three. Such as minus three as is provided in step 220.

By using the compensation factor for the cam measurement, a more accurate determination of camshaft position is provided for various engine functions. Use of the compensated cam measurement may allow the vehicle to improve both fuel economy and emission outputs.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A method of controlling an engine comprising:

determining a camshaft position change;

determining a cam phaser velocity based on the camshaft position change;

determining a compensation factor based on the cam phaser velocity; and generating a corrected cam position signal based on the compensation factor.

2. A method as recited in claim 1 further comprising generating a crankshaft delay time based on a cam phaser position and wherein determining a compensation factor comprises determining the compensation factor based on the cam phaser velocity and the crankshaft delay time.

3. A method as recited in claim 1 further comprising generating a crankshaft delay time based on a cam phaser position and a cam phaser delay and wherein determining a compensation factor comprises determining the compensation factor based on the cam phaser velocity and the crankshaft delay time.

4. A method as recited in claim 1 further comprising generating a crankshaft delay time based on a first cam phaser position in a cam advanced state and a first cam phaser delay in the cam advanced state and a second phaser position in a cam retarded state and a second cam phaser delay in the cam retarded state and wherein determining a compensation factor comprises determining the compensation factor based on the cam phaser velocity and the crankshaft delay time.

5. A method as recited in claim 1 further comprising generating an air charge estimation in response to the corrected cam position signal.

6. A method as recited in claim 1 further comprising comparing the compensation factor to a threshold, and, when the compensation factor is greater than the threshold and a cam direction changes, generating a non-corrected cam position signal.

7. A method as recited in claim 1 further comprising comparing the compensation factor to a threshold, and, when the compensation factor is greater than the threshold, generating a non-corrected cam position signal.

8. A method as recited in claim 1 wherein determining a camshaft position change comprises determining a camshaft position change for a camshaft of a variable valve timing engine.

9. A method as recited in claim 1 further comprising determining a crankshaft position and wherein determining a cam phaser velocity based on the camshaft position change comprises determining a cam phaser velocity based on the camshaft position change and the crankshaft position.

10. A method as recited in claim 1 wherein determining a camshaft position change comprises determining an exhaust camshaft position change.

11. A method as recited in claim 1 wherein determining a camshaft position change comprises determining an intake camshaft position change.

12. A control module for controlling an engine comprising:

a camshaft position module that determines a camshaft position change of a camshaft;

a cam phaser velocity module determines a cam phaser velocity based on the camshaft position change;

a cam phaser velocity module that determines a compensation factor based on the cam phaser velocity; and a cam position compensation module that generates a corrected cam position signal based on the compensation factor.

13. A control module as recited in claim 12 further comprising a measurement delay module that generates a crankshaft delay time based on a cam phaser position and wherein the compensation factor is based on the cam phaser velocity and the crankshaft delay time.

14. A control module as recited in claim 12 further comprising a measurement delay module that generates a crankshaft delay time based on a cam phaser position and a cam phaser delay and wherein the compensation factor is based on the cam phaser velocity and the crankshaft delay time.

15. A control module as recited in claim 12 further comprising a measurement delay module that generates a crankshaft delay time based on a first cam phaser position in a cam advanced state and a first cam phaser delay in the cam advanced state and a second phaser position in a cam retarded state and a second cam phaser delay in the cam retarded state and wherein cam position compensation module generates the compensation factor based on the cam phaser velocity and the crankshaft delay time.

16. A control module as recited in claim 12 further comprising an air charge estimation module that generates an air charge estimation in response to the corrected cam position signal.

17. A control module as recited in claim 12 further comprising a scheduling module that compares the compensation factor to a threshold, and, when the compensation factor is greater than the threshold and a cam direction changes, said scheduling module generates a non-corrected cam position signal.

18. A control module as recited in claim 12 further comprising a scheduling module that compares the compensation factor to a threshold, and, when the compensation factor is greater than the threshold, said scheduling module generates a non-corrected cam position signal.

19. A control module as recited in claim 12 further comprising a crankshaft position module that determines a crankshaft position and wherein cam phaser velocity module determines a cam phaser velocity based on the camshaft position change and the crankshaft position.

20. A control module as recited in claim 12 wherein the camshaft comprises an intake camshaft.

* * * * *